US006668569B1

(12) United States Patent
Jin

(10) Patent No.: US 6,668,569 B1
(45) Date of Patent: Dec. 30, 2003

(54) HEAT PUMP APPARATUS

(76) Inventor: Keum Su Jin, Room 401 Jupung Village, 316-8, Kil-Dong, Kangdong-Ku, Seoul (KR)

( * ) Notice: Subject to any disclaimer, the term of this patent is extended or adjusted under 35 U.S.C. 154(b) by 0 days.

(21) Appl. No.: 10/201,012

(22) Filed: Jul. 22, 2002

(51) Int. Cl.[7] ..... F25B 41/04

(52) U.S. Cl. ..... 62/197; 199/513; 199/509

(58) Field of Search ..... 62/160, 113, 513, 62/196.1, 196.3, 196.4, 197, 509, 503, 199, 200

(56) References Cited

U.S. PATENT DOCUMENTS 2,386,198 A * 10/1945 Dodson ..... 62/175
4,760,707 A * 8/1988 Dennis et al. ..... 62/197
6,138,467 A * 10/2000 Lifson et al. ..... 62/217

* cited by examiner

*Primary Examiner*—Harry B. Tanner
(74) *Attorney, Agent, or Firm*—Hedman & Costigan, P.C.

(57) ABSTRACT

A heat pump apparatus, improved in the operational reliability of its compressor and maintaining its COP at a desired level, is disclosed. The basic refrigeration circuit of the apparatus consists of a first pipe extending from a compressor to a four-way valve, second and third pipes sequentially connecting the four-way valve, an indoor heat exchanger, a cooling-mode expansion valve, a heating-mode expansion valve and an outdoor heat exchanger to each other, and a fourth pipe extending from the outdoor heat exchanger to the four-way valve. A refrigerant suction line extends from the four-way valve to the compressor. A main bypass line extends from the third pipe at a position between the two expansion valves to the refrigerant suction line, with a liquid refrigerant tank installed on the bypass line. A pressure control valve and a solenoid valve are installed on the bypass line at positions around the inlet and outlet ports of the liquid refrigerant tank, respectively. A second bypass line extends from the second pipe to the fourth pipe. A plurality of capillary tubes are installed in the liquid refrigerant tank and connected to both the second bypass line and a branch line branching from the main bypass line at a position around the inlet port of the pressure control valve.

3 Claims, 1 Drawing Sheet

HEAT PUMP APPARATUS

BACKGROUND OF THE INVENTION

1. Field of the Invention

The present invention relates, in general, to heat pump apparatuses and, more particularly, to a compression-ratio control device for such heat pump apparatuses.

2. Description of the Prior Art

A heat pump apparatus is an air conditioning machine that is operated with a reversed Carnot cycle to be selectively used as a heater or a cooler. As shown in FIG. 1, the basic refrigeration circuit 1 of the cycle comprises a compressor 2, a four-way valve 3, an indoor heat exchanger 4, a cooling-mode expansion valve 5, a heating-mode expansion valve 6 and an outdoor heat exchanger 7 which are sequentially connected to each other through a main refrigerant line, consisting of a plurality of refrigerant pipes 8*a*, 8*b*, 8*c* and 8*d*, such that the first pipe 8*a* starts at the outlet port of the compressor 2 and the fourth pipe 8d is ended at the four-way valve 3. In addition, the four-way valve 3 is also connected to the inlet port of the compressor 2 through a refrigerant suction line 8*e*.

In order to perform a heating-mode operation of the heat pump apparatus, the four-way valve 3 is controlled such that refrigerant flows through the refrigeration circuit in a direction as shown by the solid arrows of the drawing. During such a heating-mode operation, high pressure and high temperature gas refrigerant outputted from the compressor 2 flows to the indoor heat exchanger 4, which acts as a condenser for condensing the gas refrigerant while transmitting heat from the gas refrigerant to indoor air or water flowing around the indoor heat exchanger 4, thus heating the indoor air, producing hot water or accomplishing a drying function while condensing the gas refrigerant. The high pressure and high temperature liquid refrigerant outputted from the indoor heat exchanger 4 is expanded in the heating-mode expansion valve 6. The refrigerant from the expansion valve 6 is, thereafter, evaporated by heat at the outdoor heat exchanger 7 acting as an evaporator using a surrounding fluid, such as outdoor air used as a heat source. At the outdoor heat exchanger 7, the liquid refrigerant thus becomes low pressure and low temperature gas refrigerant, which is returned to the compressor 2 through the refrigerant suction line 8*e* so as to accomplish one cycle. During the heating-mode operation, the heat pump apparatus repeats the above-mentioned cycle.

When it is required to perform a cooling-mode operation of the heat pump apparatus, the four-way valve 3 is controlled such that refrigerant flows through the refrigeration circuit in a direction as shown by the dotted arrows of the drawing. During such a cooling-mode operation, high pressure and high temperature gas refrigerant outputted from the compressor 2 flows to the outdoor heat exchanger 7, which acts as a condenser for condensing the gas refrigerant. High pressure and high temperature liquid refrigerant outputted from the outdoor heat exchanger 7 flows to the cooling-mode expansion valve 5, thus being expanded in the valve 5. Liquid refrigerant from the cooling-mode expansion valve 5 is fed to the indoor heat exchanger 4 acting as an evaporator, and evaporated by heat transmitted from indoor air or water flowing around the indoor heat exchanger 4. Due to the evaporation of the refrigerant at the indoor heat exchanger 4, the refrigerant cools the indoor air or produces cold water. Thereafter, low pressure and low temperature gas refrigerant is returned from the indoor heat exchanger 4 to the compressor 2 so as to accomplish one cycle. During the cooling-mode operation, the heat pump apparatus repeats the above-mentioned cycle.

During a heating-mode operation of the conventional heat pump apparatus, the coefficient of performance (COP) of the apparatus is increased in proportion to the quantity of heat transmitted from the refrigerant to the indoor air or water at the indoor heat exchanger 4 acting as a condenser. The COP of the heat pump apparatus during a cooling-mode operation is increased in proportion to the quantity of heat transmitted from the indoor air or water to the refrigerant at the indoor heat exchanger 4 acting as an evaporator. When the quantity of heat, transmitted from the refrigerant to the indoor air or water at the indoor heat exchanger 4 acting as a condenser during a heating-mode operation, is increased in an effort to increase the COP of the apparatus, the temperature of the output gas refrigerant from the compressor 2 rises. In addition, when the temperature of outdoor air during such a heating-mode operation is lowered, the quantity of heat absorbed by the refrigerant at the outdoor heat exchanger 7 acting as an evaporator is reduced in proportion to a reduction in the temperature of the outdoor air. During a heating-mode operation of the conventional heat pump apparatus in the case of either of the above-mentioned two cases, the compression ratio of the compressor 2 is increased. During a cooling-mode operation of the heat pump apparatus at a high temperature of outdoor air, gas refrigerant may be incompletely condensed at the outdoor heat exchanger 7 acting as a condenser. In such a case, the difference between the condensing temperature and the evaporating temperature is enlarged, so the compression ratio of the compressor 2 is increased.

In the case of such an increase in the compression ratio of the compressor 2, the temperature of output gas refrigerant from the compressor 2 is increased, thus sometimes overheating the compressor and thermally degrading lubrication oil to lower the operational reliability of the compressor, as well as reducing volumetric and compression efficiencies of the compressor. This results in a reduction in the COP of the apparatus. In an effort to solve the problems, the compressor of a conventional heat pump apparatus may be provided with a high voltage protective switch or an inverter compressor may be used as the compressor of the heat pump apparatus, thus accomplishing a low rpm of the compressor as well as controlling the compression ratio of the compressor.

Such a conventional method may somewhat effectively control the compression ratio of compressors and does not reduce the COP of the heat pump apparatuses in the case of a heating-mode operation at an outdoor temperature not lower than 5° C. However, the method is problematic in that it is almost impossible to completely defrost the outdoor heat exchanger 7 in the case of a heating-mode operation at a cold outdoor temperature lower than 5° C., even though a defrosting means installed around the heat exchanger 7 is operated. Particularly in the coldest season, the quantity of frost formed on the outdoor heat exchanger 7 is excessively increased, so the evaporation efficiency of liquid refrigerant at the outdoor heat exchanger 7 is reduced. Such a reduction in the refrigerant evaporation efficiency at the outdoor heat exchanger 7 sometimes results in disabling of the heat pump apparatus.

SUMMARY OF THE INVENTION

Accordingly, the present invention has been made keeping in mind the above problems occurring in the prior art, and an object of the present invention is to provide a heat pump apparatus, which improves the operational reliability of its compressor and maintains its COP at a desired level.

In order to accomplish the above objects, the present invention provides a heat pump apparatus, comprising a basic refrigeration circuit including a main refrigerant line consisting of a first refrigerant pipe extending from a compressor to a four-way valve, second and third refrigerant pipes sequentially connecting the four-way valve, an indoor heat exchanger, a cooling-mode expansion valve, a heating-mode expansion valve and an outdoor heat exchanger to each other, and a fourth refrigerant pipe extending from the outdoor heat exchanger to the four-way valve; and a refrigerant suction line extending from the four-way valve to the compressor, further comprising: a main bypass line extending from the main refrigerant line at a position between the cooling-mode expansion valve and the heating-mode expansion valve installed on the third refrigerant pipe to the refrigerant suction line, with a liquid refrigerant tank installed on the main bypass line; a pressure control valve and a solenoid valve installed on the main bypass line at positions around the inlet and outlet ports of the liquid refrigerant tank, respectively; a second bypass line extending from the second refrigerant pipe at a position between the four-way valve and the indoor heat exchanger to the fourth refrigerant pipe; and a plurality of capillary tubes installed in the liquid refrigerant tank and connected to both the second bypass line and a branch line branching from the main bypass line at a position around the inlet port of the pressure control valve.

BRIEF DESCRIPTION OF THE DRAWINGS

The above and other objects, features and other advantages of the present invention will be more clearly understood from the following detailed description taken in conjunction with the accompanying drawing, in which.

DETAILED DESCRIPTION OF THE INVENTION

Figure 1:
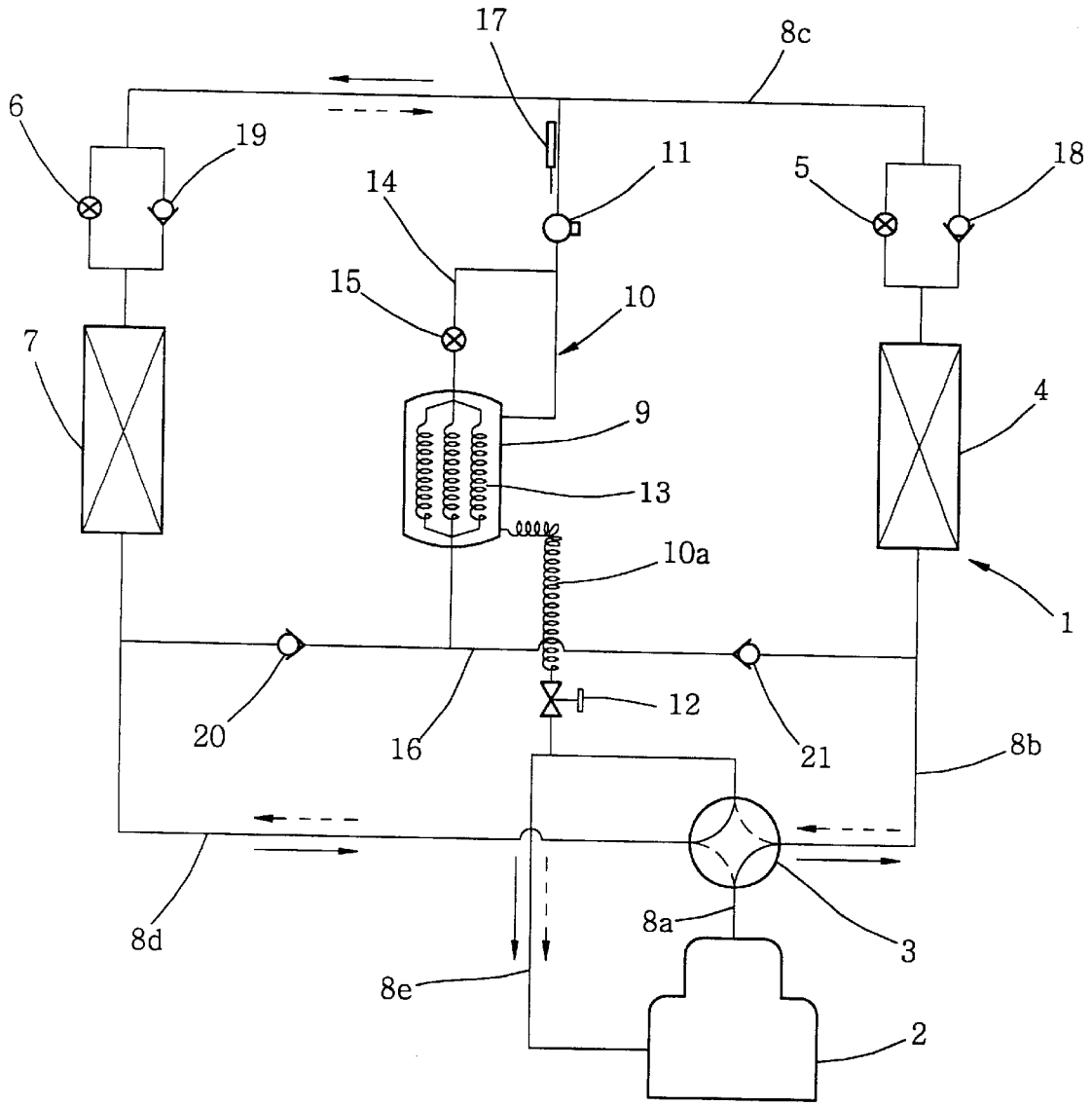
FIG. 1 is a circuit diagram, showing the construction of a heat pump apparatus in accordance with the preferred embodiment of the present invention.

FIG. 1 is a circuit diagram, showing the construction of a heat pump apparatus in accordance with the preferred embodiment of the present invention. In the drawing, the reference numeral 1 denotes a basic refrigeration circuit of this apparatus. The basic refrigeration circuit 1 of the cycle comprises a compressor 2, a four-way valve 3, an indoor heat exchanger 4, a cooling-mode expansion valve 5, a heating-mode expansion valve 6 and an outdoor heat exchanger 7 which are sequentially connected to each other through a main refrigerant line, consisting of first to fourth refrigerant pipes 8*a*, 8*b*, 8*c* and 8*d*, such that the first pipe 8*a* starts at the outlet port of the compressor 2 and the fourth pipe 8*d* is ended at the four-way valve 3. In addition, the four-way valve 3 is also connected to the inlet port of the compressor 2 through a refrigerant suction line 8*e*. During a heating-mode operation of the apparatus, the indoor heat exchanger 4 acts as a condenser, while the outdoor heat exchanger 7 acts as an evaporator. During a cooling-mode operation of the apparatus, the outdoor heat exchanger 7 acts as a condenser, while the indoor heat exchanger 4 acts as an evaporator.

During a heating-or cooling-mode operation of the heat pump apparatus, air, water or air and water is used as a surrounding fluid of the indoor and outdoor heat exchangers 4 and 7, which transmits or receives heat to or from refrigerant at the heat exchangers.

In the drawing, the reference numeral 9 denotes a liquid refrigerant tank installed on a main bypass line 10. The main bypass line 10 extends from the main refrigerant line at a position between the cooling-mode expansion valve 5 and the heating-mode expansion valve 6 installed on the third refrigerant pipe 8*c* to the refrigerant suction line 8*e*. This main bypass line 10 is formed as a capillary tube 10*a* at a portion around the outlet port of the liquid refrigerant tank 9.

The reference numerals 11 and 12 respectively denote a pressure control valve and a solenoid valve. The two valves 11 and 12 are installed on the main bypass line 10 at positions around the inlet and outlet ports of the liquid refrigerant tank 9, respectively.

The reference numeral 13 denotes a plurality of capillary tubes. The capillary tubes 13 are installed in the liquid refrigerant tank 9 and connected to both a branch line 14 at their inlet ports and a second bypass line 16 at their outlet ports. The branch line 14 branches from the main bypass line 10 at a position around the inlet port of the pressure control valve 11. The second bypass line 16 extends from the second refrigerant pipe 8*b* at a position between the four-way valve 3 and the indoor heat exchanger 4 to the fourth refrigerant pipe 8*e*. An additional expansion valve 15 is installed on the branch line 14.

A pressure sensor 17 or a temperature sensor is installed on the main bypass line 10 at a position around the inlet port of the pressure control valve 11, so the pressure control valve 11 and the solenoid valve are selectively opened or closed in response to signals outputted from the sensor 17. That is, when the pressure acting in the main bypass line 10 is higher than a predetermined reference level, for example, 18~21 kg/cm$^2$ during a heating-mode operation of the heat pump apparatus using R-22 as refrigerant, the pressure control valve 11 is opened and the solenoid valve 12 is closed. However, when the pressure acting in the main bypass line 10 is not higher than the predetermined reference level, the pressure control valve 11 is closed and the solenoid valve 12 is opened.

In the drawing, the reference numerals 18, 19, 20, and 21 denote first, second, third and fourth check valves, respectively.

In order to perform a heating-mode operation of the heat pump apparatus, the four-way valve 3 is controlled such that refrigerant flows through the refrigeration circuit in a direction as shown by the solid arrows of the drawing. During such a heating-mode operation, high pressure and high temperature gas refrigerant outputted from the compressor 2 flows to the indoor heat exchanger 4, which acts as a condenser for condensing the gas refrigerant while transmitting heat from the gas refrigerant to the surrounding fluid, such as indoor air and/or water flowing around the indoor heat exchanger 4, thus heating the indoor air, producing hot water or accomplishing a drying function while condensing the gas refrigerant. The high pressure and high temperature liquid refrigerant outputted from the indoor heat exchanger 4 is expanded in the heating-mode expansion valve 6. The refrigerant from the expansion valve 6 is, thereafter, evaporated by heat at the outdoor heat exchanger 7 acting as an evaporator using the surrounding fluid, such as outdoor air and/or water. At the outdoor heat exchanger 7, the liquid refrigerant thus becomes low pressure and low temperature gas refrigerant, which is returned to the compressor 2 through the refrigerant suction line 8*e* so as to accomplish one cycle. During the heating-mode operation, the heat pump apparatus repeats the above-mentioned cycle. When it is required to perform a cooling-mode operation of the heat pump apparatus, the four-way valve 3 is controlled such that refrigerant flows through the refrigeration circuit in a direction as shown by the dotted arrows of the drawing. During such a cooling-mode operation, high pressure and high temperature gas refrigerant outputted from the compressor 2 flows to the outdoor heat exchanger 7, which acts as a condenser for condensing the gas refrigerant by absorbing heat from the refrigerant using outdoor air or condensed water. High pressure and high temperature liquid refrigerant outputted from the outdoor heat exchanger 7 flows to the cooling-mode expansion valve 5, thus being expanded in the valve 5. Liquid refrigerant from the cooling-mode expansion valve 5 is fed to the indoor heat exchanger 4 acting as an evaporator, and evaporated by heat transmitted from the surrounding fluid flowing around the indoor heat exchanger 4. Due to the evaporation of the refrigerant at the indoor heat exchanger 4, the refrigerant cools the surrounding fluid. Thereafter, low pressure and low temperature gas refrigerant is returned from the indoor heat exchanger 4 to the compressor 2 so as to accomplish one cycle. During the cooling-mode operation, the heat pump apparatus repeats the above-mentioned cycle.

During a heating-mode operation of the heat pump apparatus, the quantity of heat absorbed at the outdoor heat exchanger 7 acting as an evaporator may be excessively low, or during a cooling-mode operation, the outdoor heat exchanger 7 acting as a condenser may fail to completely condense gas refrigerant. In such a case, the compression ratio of the compressor 2 is increased, and results in an increase in pressure of refrigerant flowing in the third refrigerant pipe 8*c*. When the pressure of refrigerant flowing in the third refrigerant pipe 8*c* is excessively increased higher than a predetermined reference level, the pressure sensor 17 installed on the main bypass line 10 at a position around the inlet port of the pressure control valve 11 senses the pressure, and outputs signals to both the pressure control valve 11 and the solenoid valve 12. In response to the signals from the sensor 17, the pressure control valve 11 is opened, and the open solenoid valve 12 is closed.

When the pressure control valve 11 is opened as described above, a part of the refrigerant flowing in the third pipe 8*c* is bypassed through the main bypass line 10 to flow to the liquid refrigerant tank 9, so the pressure of refrigerant flowing in the third refrigerant pipe 8*c* is reduced not higher than the predetermined reference level. In such a case, a part of the bypassed refrigerant branches from the bypass line 10 through the branch line 14, and is reduced in its pressure and expands at the capillary tubes 13, thus absorbing heat from the bypassed refrigerant in the liquid refrigerant tank 9. Therefore, the liquid refrigerant flowing in the capillary tubes 13 becomes gas refrigerant, while the liquid refrigerant flowing in the liquid refrigerant tank 9 is cooled.

During a heating-mode operation of the apparatus, the gas refrigerant from the capillary tubes 13 passes through the second bypass line 16 and the third check valve 20, in order, thus flowing together with evaporated gas refrigerant outputted from the outdoor heat exchanger 7, at the fourth refrigerant pipe 8*d*, prior to being returned to the compressor 2. In such a case, the fourth check valve 21 is closed due to pressure of the high pressure and high temperature gas refrigerant outputted from the compressor 2. During a cooling-mode operation of the apparatus, the gas refrigerant from the capillary tubes 13 passes through the second bypass line 16 and the fourth check valve 21, in order, thus flowing together with evaporated gas refrigerant outputted from the indoor heat exchanger 4, at the second refrigerant pipe 8*b*, prior to being returned to the compressor 2. It is thus possible to reduce the compression ratio of the compressor 2.

When the compression ratio of the compressor 2 is reduced and the pressure of refrigerant flowing in the third refrigerant pipe 8*c* is reduced not higher than the predetermined reference level as described above, the pressure sensor 17 stops outputting signals to the pressure control valve 11 and the solenoid valve 12. Therefore, the pressure control valve 11 is closed, while the solenoid valve 12 is opened. The cold liquid refrigerant is thus discharged from the liquid refrigerant tank 9 while expanding in the capillary tube 10*a* of the main bypass line 10, and flows together with gas refrigerant in the refrigerant suction line 8*e*, thus being returned to the compressor 2.

When it is required to reduce the compression ratio of the compressor 2, the liquid refrigerant may be reduced in its pressure and expand only in the capillary tubes 13 as described above. However, when the reduction in the pressure of the refrigerant and the expansion of the refrigerant in the capillary tubes 13 are not sufficient, the additional expansion valve 15 of the branch line 14 may be operated to additionally control the degree of superheating of the refrigerant and desirably control evaporation efficiency of the liquid refrigerant to a desired level.

As described above, the present invention provides a heat pump apparatus, which improves the operational reliability of its compressor and maintains its COP at a desired level. In this heat pump apparatus, a liquid refrigerant tank is connected to the main refrigerant line through a bypass line extending from a main refrigerant line at a position between the heating-and cooling-mode expansion valves, with a plurality of capillary tubes installed in the liquid refrigerant tank. During an operation of the apparatus with pressure of refrigerant excessively increased higher than a predetermined reference level, evaporated gas refrigerant discharged from the capillary tubes flows together with gas refrigerant flowing in the outlet refrigerant pipe of a heat exchanger acting as an evaporator, prior to being returned to a compressor. Cold liquid refrigerant outputted from the liquid refrigerant tank primarily expands in an additional capillary tube, and flows together with refrigerant in the refrigerant suction line so as to be returned to the compressor. Therefore, it is possible for the heat pump apparatus to regulate the compression ratio of the compressor to a level not higher than a predetermined reference level, so the heat pump apparatus improves the operational reliability of its compressor, and accomplishes desired operational efficiency of the compressor during a heating-mode operation in the coldest season, thus maintaining its COP at a desired level.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A heat pump apparatus, comprising a basic refrigeration circuit including a main refrigerant line consisting of a first refrigerant pipe extending from a compressor to a four-way valve, second and third refrigerant pipes sequentially connecting the four-way valve, an indoor heat exchanger, a cooling-mode expansion valve, a heating-mode expansion valve and an outdoor heat exchanger to each other, and a fourth refrigerant pipe extending from the outdoor heat exchanger to said four-way valve; and a refrigerant suction line extending from said four-way valve to the compressor, further comprising:

a main bypass line extending from the main refrigerant line at a position between the cooling-mode expansion valve and the heating-mode expansion valve installed on the third refrigerant pipe to the refrigerant suction line, with a liquid refrigerant tank installed on said main bypass line;

a pressure control valve and a solenoid valve installed on said main bypass line at positions around inlet and outlet ports of the liquid refrigerant tank, respectively;

a second bypass line extending from the second refrigerant pipe at a position between the four-way valve and the indoor heat exchanger to the fourth refrigerant pipe; and a plurality of capillary tubes installed in said liquid refrigerant tank and connected to both the second bypass line and a branch line branching from the main bypass line at a position around an inlet port of the pressure control valve.

2. The heat pump apparatus according to claim 1, wherein an additional expansion valve is installed on said branch line.

3. The heat pump apparatus according to claim 1, wherein the main bypass line is formed as a capillary tube at a portion around an outlet port of said liquid refrigerant tank.

* * * * *